US010306946B2

(12) United States Patent
Zavala

(10) Patent No.: US 10,306,946 B2
(45) Date of Patent: Jun. 4, 2019

(54) ARTICLE OF FOOTWEAR HAVING HEEL PORTION WITH KNITTED COMPONENT

(71) Applicant: NIKE, Inc., Beaverton, OR (US)

(72) Inventor: Roberto Zavala, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 200 days.

(21) Appl. No.: 13/893,712

(22) Filed: May 14, 2013

(65) Prior Publication Data

US 2014/0338226 A1 Nov. 20, 2014

(51) Int. Cl.

| | |
|---|---|
| ***A43B 1/04*** | (2006.01) |
| ***A43B 23/02*** | (2006.01) |
| ***A43B 23/08*** | (2006.01) |
| ***A43C 11/00*** | (2006.01) |
| ***D04B 1/10*** | (2006.01) |

(52) U.S. Cl.

CPC ..... *A43B 1/04* (2013.01); *A43B 23/0205* (2013.01); *A43B 23/088* (2013.01); *A43C 11/006* (2013.01); *D04B 1/102* (2013.01); *D10B 2403/032* (2013.01); *D10B 2501/043* (2013.01)

(58) Field of Classification Search

CPC ..... A43B 1/04; A43B 23/0205; A43B 23/025; D04B 1/102; D04B 1/08; D04B 1/108; D04B 1/16

See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |

(Continued)

FOREIGN PATENT DOCUMENTS

| | | | |
|---|---|---|---|
| CN | 1518910 | A | 8/2004 |
| CN | 100415132 | C | 9/2008 |

(Continued)

OTHER PUBLICATIONS http://www.threadsmagazine.com/item/4160/know-your-knits/page/all.*

(Continued)

*Primary Examiner* — Megan E Lynch
(74) *Attorney, Agent, or Firm* — Brinks Gilson & Lione

(57) ABSTRACT

An article of footwear includes a sole structure and an upper coupled to the sole structure. The upper includes a lower edge that is disposed adjacent to the sole structure. The upper further includes a collar defining an opening to a void within the upper. The collar defines an upper edge of the upper that is spaced away from the lower edge. The upper includes a forward portion and a heel portion. The heel portion includes a knitted component of unitary knit construction. The knitted component at least partially defines the upper edge and the lower edge of the upper. The knitted component includes a first side edge that is attached to the forward portion along a first side. The knitted component also includes a second side edge that is attached to the forward portion along a second side.

18 Claims, 8 Drawing Sheets

(56) References Cited

U.S. PATENT DOCUMENTS

| | | | | |
|---|---|---|---|---|
| 2,147,197 | A | 2/1939 | Glidden | |
| 2,314,098 | A | 3/1943 | McDonald | |
| 2,330,199 | A | 9/1943 | Basch | |
| 2,343,390 | A | 3/1944 | Ushakoff | |
| 2,400,692 | A | 5/1946 | Herbert | |
| 2,440,393 | A | 4/1948 | Clark | |
| 2,569,764 | A | 10/1951 | Jonas | |
| 2,586,045 | A | 2/1952 | Hoza | |
| 2,608,078 | A | 8/1952 | Anderson | |
| 2,641,004 | A | 6/1953 | Whiting et al. | |
| 2,675,631 | A | 4/1954 | Doughty | |
| 2,950,611 | A | 8/1960 | Getaz | |
| 2,994,322 | A | 8/1961 | Cullen et al. | |
| 3,130,566 | A | 4/1964 | Chesebro | |
| 3,583,081 | A | 6/1971 | Hayashi | |
| 3,694,940 | A | 10/1972 | Stohr | |
| 3,704,474 | A | 12/1972 | Winkler | |
| 3,766,566 | A | 10/1973 | Tadakoro | |
| 3,778,856 | A | 12/1973 | Christie et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,607,439 | A | 8/1986 | Harada | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 5,031,423 | A | 7/1991 | Ikenaga | |
| 5,095,720 | A | 3/1992 | Tibbals, Jr. | |
| 5,117,567 | A | 6/1992 | Berger | |
| 5,152,025 | A | 10/1992 | Hirmas | |
| 5,192,601 | A | 3/1993 | Neisler | |
| 5,345,638 | A * | 9/1994 | Nishida | 12/146 C |
| 5,353,524 | A | 10/1994 | Brier | |
| 5,371,957 | A | 12/1994 | Gaudio | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,729,918 | A | 3/1998 | Smets | |
| 5,735,145 | A | 4/1998 | Pernick | |
| 5,746,013 | A | 5/1998 | Fay, Sr. | |
| 5,765,296 | A | 6/1998 | Ludemann et al. | |
| 5,884,419 | A | 3/1999 | Davidowitz et al. | |
| 5,996,189 | A | 12/1999 | Wang | |
| 6,029,376 | A | 2/2000 | Cass | |
| 6,032,387 | A | 3/2000 | Johnson | |
| 6,052,921 | A | 4/2000 | Oreck | |
| 6,088,936 | A | 7/2000 | Bahl | |
| 6,151,802 | A | 11/2000 | Reynolds | |
| 6,170,175 | B1 | 1/2001 | Funk | |
| 6,308,438 | B1 | 10/2001 | Throneburg et al. | |
| 6,333,105 | B1 | 12/2001 | Tanaka et al. | |
| 6,401,364 | B1 | 6/2002 | Burt | |
| 6,558,784 | B1 | 5/2003 | Norton et al. | |
| 6,588,237 | B2 | 7/2003 | Cole et al. | |
| 6,754,983 | B2 | 6/2004 | Hatfield et al. | |
| 6,910,288 | B2 | 6/2005 | Dua | |
| 6,922,917 | B2 | 8/2005 | Kerns et al. | |
| 6,931,762 | B1 | 8/2005 | Dua | |
| D517,297 | S | 3/2006 | Jones et al. | |
| 7,051,460 | B2 * | 5/2006 | Orei et al. | 36/84 |
| 7,056,402 | B2 | 6/2006 | Koerwien et al. | |
| 7,347,011 | B2 | 2/2008 | Dua et al. | |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,682,219 | B2 | 3/2010 | Falla | |
| 8,490,299 | B2 | 7/2013 | Dua et al. | |
| 2002/0078599 | A1 | 6/2002 | Delgorgue et al. | |
| 2002/0148258 | A1 | 10/2002 | Cole et al. | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2005/0081402 | A1 | 4/2005 | Orei et al. | |
| 2005/0115284 | A1 * | 6/2005 | Dua | A43B 1/04 66/178 R |
| 2005/0193592 | A1 * | 9/2005 | Dua | A43B 1/04 36/45 |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0130359 | A1 | 6/2006 | Dua et al. | |
| 2006/0162187 | A1 | 7/2006 | Byrnes et al. | |
| 2007/0022627 | A1 * | 2/2007 | Sokolowski et al. | 36/3 A |
| 2007/0180730 | A1 | 8/2007 | Greene et al. | |
| 2008/0017294 | A1 | 1/2008 | Bailey et al. | |
| 2008/0078102 | A1 | 4/2008 | Kilgore et al. | |
| 2008/0110048 | A1 * | 5/2008 | Dua et al. | 36/45 |
| 2008/0110049 | A1 * | 5/2008 | Sokolowski et al. | 36/50.1 |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2009/0282607 | A1 * | 11/2009 | Kaneda | 2/239 |
| 2010/0051132 | A1 | 3/2010 | Glenn | |
| 2010/0154256 | A1 * | 6/2010 | Dua | 36/25 R |
| 2010/0170651 | A1 | 7/2010 | Scherb et al. | |
| 2011/0030244 | A1 | 2/2011 | Motawi et al. | |
| 2011/0078921 | A1 | 4/2011 | Greene et al. | |
| 2012/0233882 | A1 | 9/2012 | Huffa et al. | |
| 2012/0246973 | A1 * | 10/2012 | Dua | 36/83 |
| 2012/0255201 | A1 | 10/2012 | Little | |

FOREIGN PATENT DOCUMENTS

| | | | |
|---|---|---|---|
| CN | 101562999 | A | 10/2009 |
| CN | 102170801 | A | 8/2011 |
| DE | 475363 | | 4/1929 |
| DE | 475363 | C | 4/1929 |
| DE | 870963 | C | 3/1953 |
| DE | 1084173 | | 6/1960 |
| DE | 19738433 | | 4/1998 |
| DE | 19728848 | | 1/1999 |
| EP | 0448714 | | 10/1991 |
| EP | 0728860 | | 8/1996 |
| EP | 0758693 | | 2/1997 |
| EP | 0279950 | A2 | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 538865 | | 8/1941 |
| GB | 643759 | A | 9/1950 |
| GB | 684619 | | 12/1952 |
| GB | 2018837 | A | 10/1979 |
| GB | 1603487 | | 11/1981 |
| JP | S51-176793 | | 12/1951 |
| JP | H06113905 | | 4/1994 |
| JP | H08109553 | | 4/1996 |
| JP | H11302943 | | 11/1999 |
| JP | 2004-230151 | | 8/2004 |
| JP | 2010-508994 | | 3/2010 |
| JP | 2012-512698 | | 6/2012 |
| JP | 2012-161634 | | 8/2012 |
| NL | 7304678 | | 10/1974 |
| WO | 9003744 | | 4/1990 |
| WO | 0032861 | | 6/2000 |
| WO | 0231247 | | 4/2002 |
| WO | WO 2007/002068 | A2 | 1/2007 |

(56) References Cited

FOREIGN PATENT DOCUMENTS

| | | | |
|---|---|---|---|
| WO | WO 2008/060928 | A1 | 5/2008 |
| WO | WO 2010/080182 | A1 | 7/2010 |
| WO | WO 2014/131762 | A2 | 9/2014 |

OTHER PUBLICATIONS

Letter from Bruce Huffa dated Dec. 23, 2013 (71 Pages).
International Search Report and Written Opinion for Application PCT/US2014/037768, dated Sep. 10, 2014.
International Search Report and Written Opinion for corresponding PCT/US2015/045230 dated Mar. 2, 2016, 18 pages.
International Preliminary Report on Patentability for PCT/US2014/037768 dated Nov. 17, 2015, 7 pages (Reference Was Previously Submitted on Jan. 15, 2016).
Decision of the Intellectual Property Office and English translation for corresponding Taiwan Application No. 103116308 dated Nov. 10, 2015, 25 pages.
International Preliminary Report on Patentability dated Nov. 17, 2015, 7 pages.
Allowance Decision and English translation for corresponding ROC (Taiwan) Patent Application No. 103116308 dated Jul. 27, 2016, 4 pages.
Declaration of Dr. Edward C. Frederick from the US Patent and Trademark Office Inter Partes Review of U.S. Pat. No. 7,347,011 (178 pp).
David J. Spencer, Knitting Technology: A Comprehensive Handbook and Practical Guide (Third ed., Woodhead Publishing Ltd. 2001) (413 pp).
Excerpt of Hannelore Eberle et al., Clothing Technology (Third English ed., Beuth-Verlag GmnH 2002) (book cover and back; pp. 2-3, 83).
Utility U.S. Appl. No. 13/681,842, filed Nov. 20, 2012.
Utility U.S. Appl. No. 13/529,381, filed Jun. 21, 2012.
International Search Report and Written Opinion in connection with PCT/US2012/028576 dated Oct. 1, 2012.
International Preliminary Report on Patentability in connection with PCT/US2012/028576 dated Sep. 26, 2013.
International Preliminary Report on Patentability in connection with PCT/US2012/028534 dated Sep. 26, 2013.
International Search Report and Written Opinion in connection with PCT/US2012/028559 dated Oct. 19, 2012.
International Search Report and Written Opinion in connection with PCT/US2012/028534 dated Oct. 17, 2012.
Utility U.S. Appl. No. 13/048,514, filed Mar. 15, 2011.
International Search Report and Written Opinion in connection with PCT/US2009/056795 dated Apr. 20, 2010.
Utility U.S. Appl. No. 12/338,726, filed Dec. 18, 2008.
Utility U.S. Appl. No. 13/691,316, filed Nov. 30, 2012.
Office Action and English translation for corresponding Chinese Patent Application No. 2014800326752 dated Sep. 8, 2016, 17 pages.
Office Action and English translation for Japanese Application No. 2016-514018, dated Mar. 2, 2017, 9 pages.
Office Action and English translation of relevant portions for Chinese Application No. 2014800326752, dated Mar. 2, 2017, 18 pages.
Examination Report for European Application No. 14735699.2 dated Jun. 22, 2017, 8 pages.
Office Action and English translation for Korean Application No. 10-2015-7034984, dated Jun. 8, 2017, 20 pages.
Office Action and English translation of relevant portions for Chinese Application No. 2014800326752, dated Oct. 16, 2017, 5 pages.
Office Action and English translation for Japanese Application No. 2016-514018, dated Nov. 9, 2017, 10 pages.
Office Action and partial English translation report for Mexican Application No. MX/a/2015/015754, dated Dec. 7, 2018, 10 pages.
Office Action and English translation for Argentina Application No. 20140101941, dated Dec. 19, 2018, 5 pages.

* cited by examiner

ARTICLE OF FOOTWEAR HAVING HEEL PORTION WITH KNITTED COMPONENT

BACKGROUND

Conventional articles of footwear generally include two primary elements an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each imparts different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each imparts different properties to various areas of the footwear.

SUMMARY

An article of footwear is disclosed that includes a sole structure and an upper coupled to the sole structure. The upper includes a lower edge that is disposed adjacent to the sole structure. The upper further includes a collar defining an opening to a void within the upper. The collar defines an upper edge of the upper that is spaced away from the lower edge. The upper includes a forward portion and a heel portion. The heel portion includes a knitted component of unitary knit construction. The knitted component at least partially defines the upper edge and the lower edge of the upper. The knitted component includes a first side edge that is attached to the forward portion along a first side. The knitted component also includes a second side edge that is attached to the forward portion along a second side.

Also, an article of footwear is disclosed that includes a sole structure and an upper coupled to the sole structure. The upper includes a forward portion formed of a first component and a heel portion formed of a second component, the first component being separate from the second component. The forward portion and the heel portion being joined to each other along at least one seam. The heel portion includes a heel knitted component of unitary knit construction. The heel knitted component has a first knitted zone associated with a first amount of stretch resistance and a second knitted zone associated with a second amount of stretch resistance. The first amount of stretch resistance of the first knitted zone is larger than the second amount of stretch resistance of the second knitted zone.

Moreover, an article of footwear is disclosed that includes a sole structure and an upper coupled to the sole structure. The upper includes a lower edge that is disposed adjacent the sole structure. The upper includes a collar defining an opening to a void within the upper. The collar defines an upper edge of the upper that is spaced away from the lower edge. The upper also includes a forward portion including a forward knitted component of unitary knit construction. Additionally, the upper includes a heel portion including a heel knitted component of unitary knit construction. The heel portion has a first knitted zone, a second knitted zone, and a third knitted zone. The first knitted zone is associated with a first amount of stretch resistance, the second knitted zone is associated with a second amount of stretch resistance, and the third knitted zone is associated with a third amount of stretch resistance. The first amount of stretch resistance is larger than the second amount of stretch resistance, and the second amount of stretch resistance is larger than the third amount of stretch resistance. The third knitted zone partially defines the collar and the upper edge. The first knitted zone partially defines the lower edge. The second knitted zone is cooperatively surrounded by the first knitted zone and the third knitted zone. The heel knitted component includes a first edge that is joined via stitching to the forward knitted component on a medial side of the upper. The heel knitted component further includes a second edge that is joined via stitching to the forward knitted component on a lateral side of the upper.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose an article of footwear having an upper that includes at least one knitted component. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, soccer shoes, sprinting shoes, tennis shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

Footwear Configurations

Figure 1:
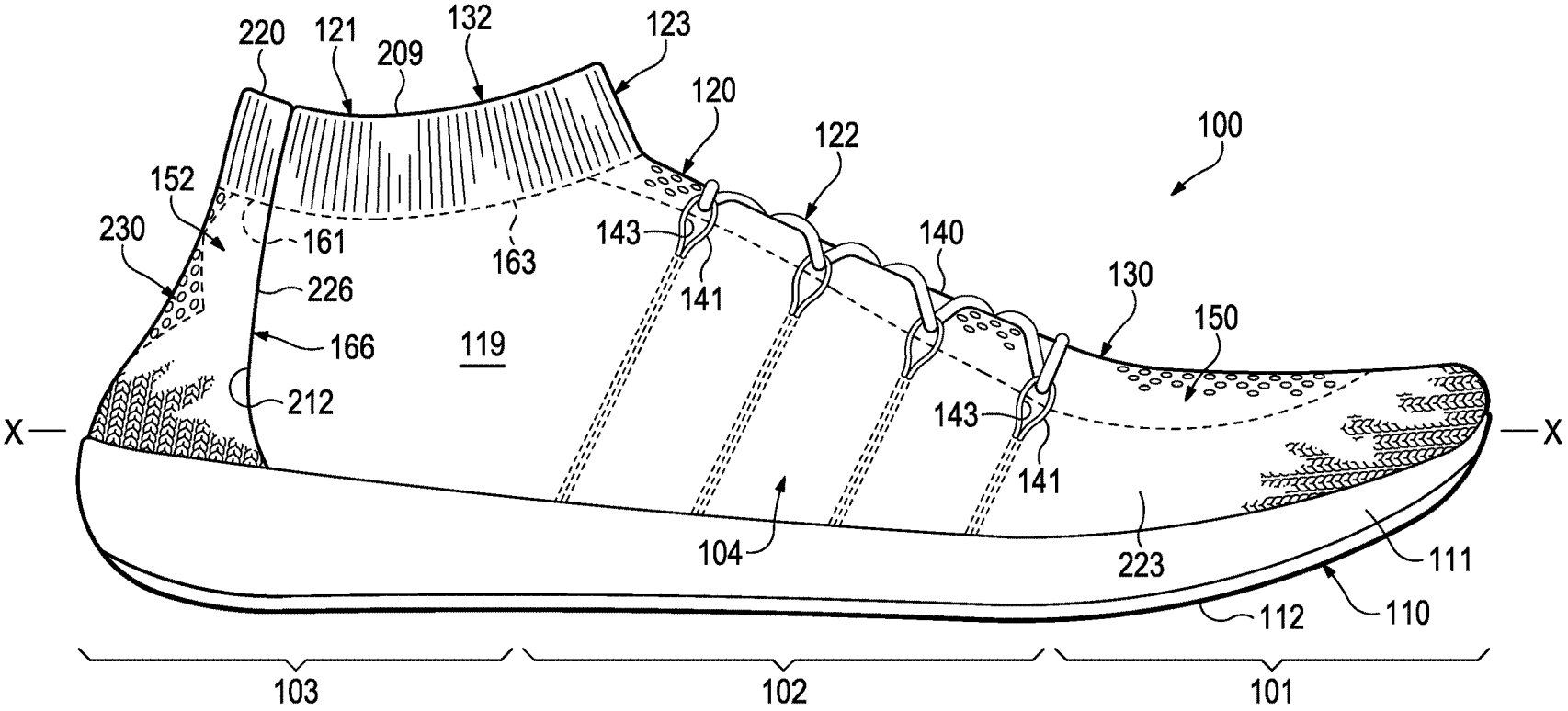
FIG. 1 is a lateral side view of an article of footwear according to exemplary embodiments of the present disclosure.
Figure 2:
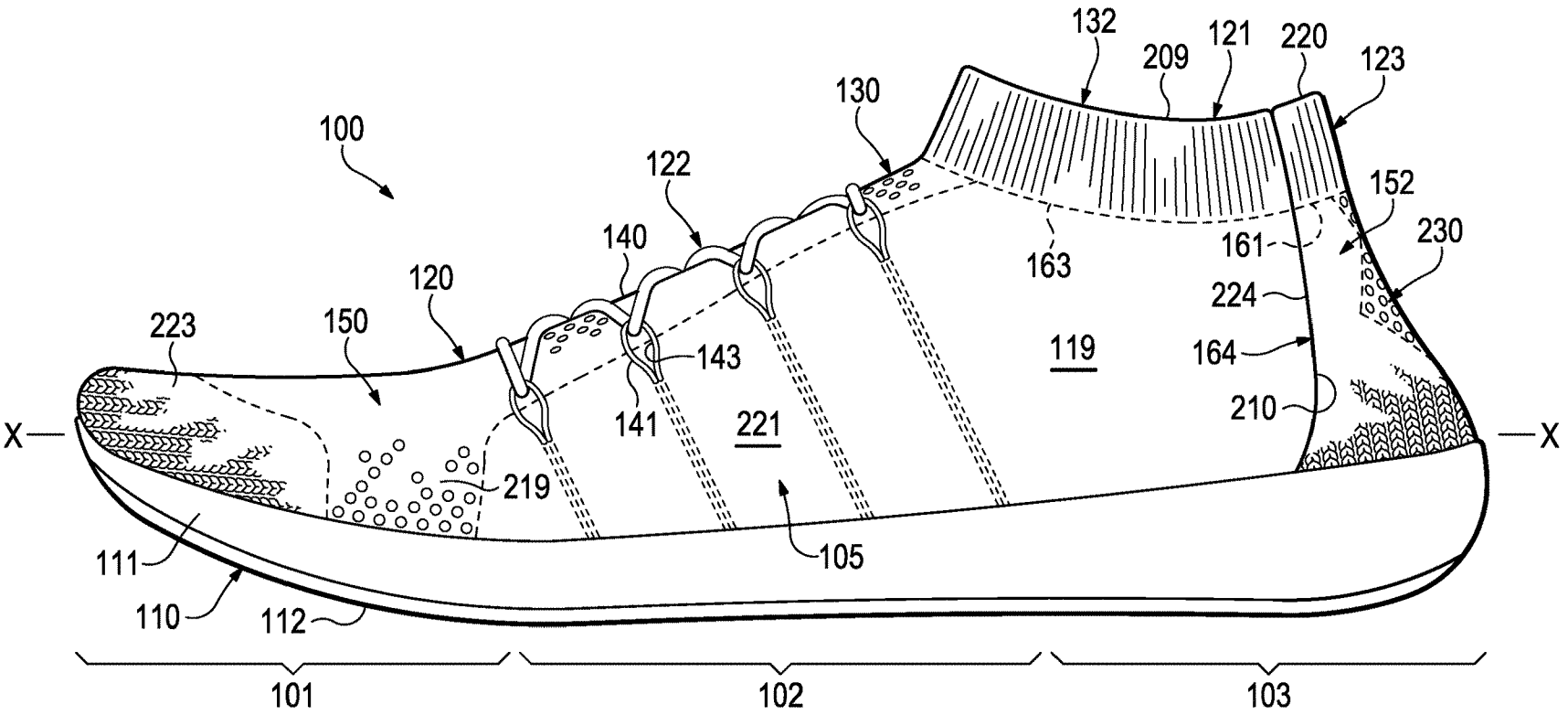
FIG. 2 is a medial side view of the article of footwear of FIG. 1.
Figure 3:
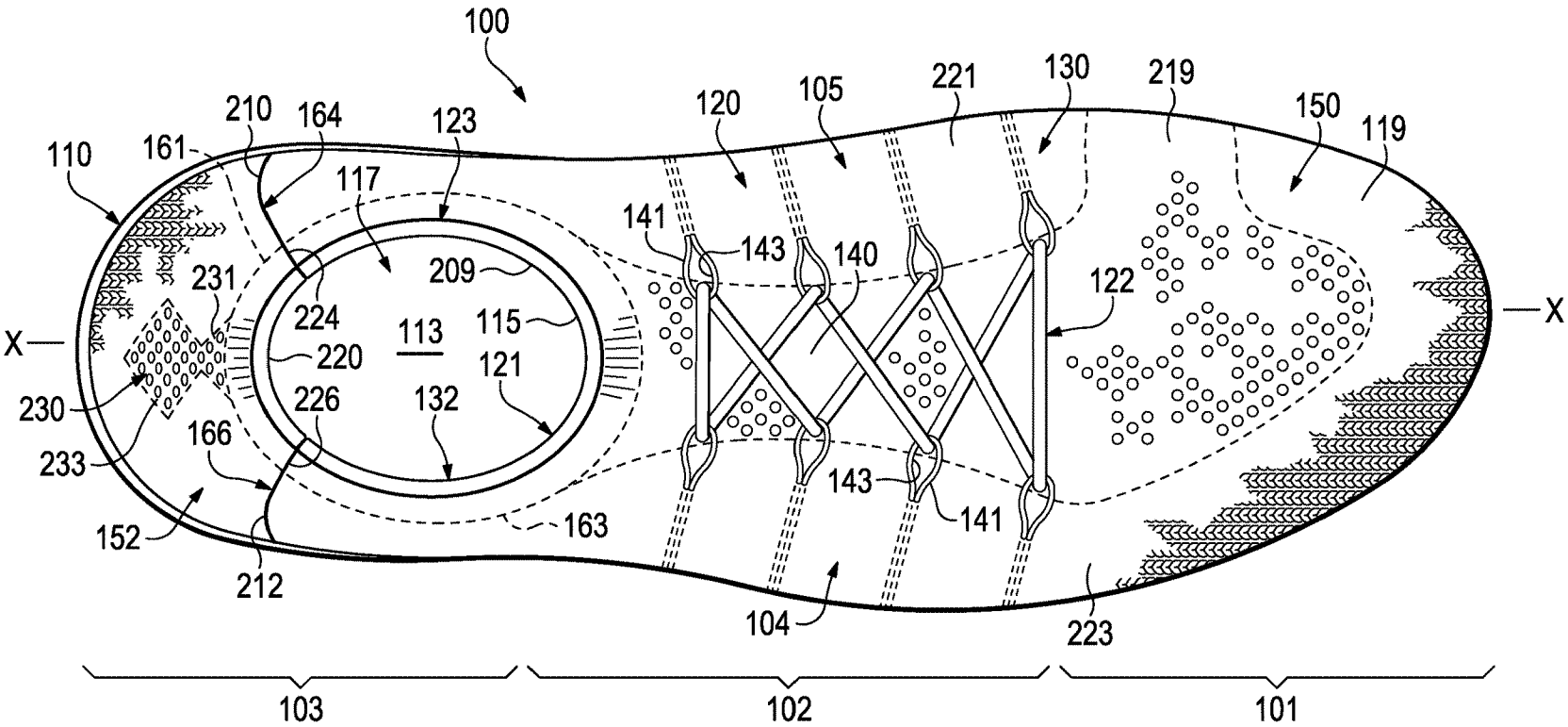
FIG. 3 is a top view of the article of footwear of FIG. 1.

FIGS. 1 through 3 illustrate exemplary embodiments of an article of footwear 100, also referred to simply as footwear 100. In some embodiments, article of footwear 100 may generally include a sole structure 110 and an upper 120.

For reference purposes, footwear 100 may be divided generally along a longitudinal axis X into three general regions: a forefoot region 101, a midfoot region 102, and a heel region 103. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of forefoot region 101, midfoot region 102, and heel region 103 and correspond with opposite sides of footwear 100. More particularly, lateral side 104 corresponds with an outside area of the foot (i.e., the surface that faces away from the other foot), and medial side 105 corresponds with an inside area of the foot (i.e., the surface that faces toward the other foot). Forefoot region 101, midfoot region 102, and heel region 103 and lateral side 104, medial side 105 are not intended to demarcate precise areas of footwear 100. Rather, forefoot region 101, midfoot region 102, and heel region 103 and lateral side 104, medial side 105 are intended to represent general areas of footwear 100 to aid in the following discussion. In addition to footwear 100, forefoot region 101, midfoot region 102, and heel region 103 and lateral side 104, medial side 105 can also independently refer to sole structure 110, upper 120, and individual elements thereof.

Sole structure 110 can be secured to upper 120 and can extend between the foot and the ground when footwear 100 is worn. In some embodiments, the sole structure 110 can generally include a midsole 111 and an outsole 112.

Midsole 111 can be secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In additional embodiments, midsole 111 may incorporate plates, moderators, fluid-filled chambers, lasting elements, or motion control members that further attenuate forces, enhance stability, or influence the motions of the foot. Midsole 111 can also be primarily formed from a fluid-filled chamber.

Outsole 112 can be secured to a lower surface of midsole 111. Outsole 112 can also be formed from a wear-resistant rubber material that is textured to impart traction.

The sole structure 110 can further include a sockliner 113 in some embodiments. Sockliner 113 is shown partially in FIG. 3. Sockliner 113 can be located within upper 120 and can be positioned to extend under a lower surface of the foot to enhance the comfort of footwear 100.

Although this configuration for sole structure 110 provides an example of a sole structure 110 that may be used in connection with upper 120, a variety of other conventional or nonconventional configurations for sole structure 110 may also be used. Accordingly, in other embodiments, the features of sole structure 110 or any sole structure used with upper 120 may vary.

Upper 120 will now be discussed generally. Upper 120 can define a void 117 within footwear 100 for receiving and securing a foot relative to sole structure 110. Void 117 is shaped to accommodate the foot and extends along a lateral side of the foot, along a medial side of the foot, over the foot and toes, around the heel, and under the foot.

Upper 120 can define a collar 130 with an upper edge 132 that defines an opening 121. Opening 121 can provide access to void 117 for the wearer's foot and can be located, at least, in heel region 103.

A tongue 140 can be included forward of collar 130 and can extend longitudinally toward forefoot region 101 and between lateral side 104 and medial side 105. As shown in the illustrated embodiments, tongue 140 can be integrally attached to forefoot region 101, lateral side 104, and medial side 105. In other embodiments, tongue 140 can be detached from lateral side 104 and medial side 105. As such, tongue 140 can be moveably received within an open throat area of upper 120 between lateral side 104 and medial side 105.

In some embodiments, closure element 122 can also be included that is used to selectively secure upper 120 to the wearer's foot. Closure element 122 can be of any suitable type, such as a lace as shown in the illustrated embodiments. In other embodiments, closure element 122 may also include one or more buckles, straps, or other suitable implements for securing upper 120 to a wearer's foot.

In an exemplary embodiment, closure element 122 may be configured to interact with tensile strands 141 to assist with securing upper 120 to a wearer's foot. In the illustrated embodiment, upper 120 includes a plurality of tensile strands 141 that extend upward along upper 120 from sole structure 110 and extend back down forming looped ends to provide apertures 143 that receive closure element 122. Tensile strands 141 suitable for use with upper 120 may include the tensile strands and/or tensile elements disclosed in one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety.

In this embodiment, apertures 143 provided by strands 141 are spaced apart along axis X and between lateral side 104 and medial side 105. Accordingly, closure element 122 extends along axis X and alternates between lateral side 104 and medial side 105. By tensioning closure element 122, the wearer can modify dimensions of upper 120 to accommodate proportions of the foot. More particularly, closure element 122 can permit the wearer to tighten upper 120 around the foot, and closure element 122 can permit the wearer to loosen upper 120 to facilitate entry and removal of the foot from void 117 through opening 121.

In some configurations, upper 120 can also extend at least partially under the wearer's foot. For example, sole structure 110 is removed in FIG. 4, and as shown upper 120 can include a strobel 125 that is attached along a periphery to a lower edge 160. Strobel 125 can be attached via stitching 162 as shown in the illustrated embodiments, via fasteners, via adhesives, or via another attachment device. Accordingly, strobel 125 extends under the wearer's foot. As mentioned above, sole structure 110 can include a sockliner 113 and midsole 111. In these embodiments, sockliner 113 can be layered over an upper surface of strobel 125 within void 117, and midsole 111 can be joined to a lower surface of strobel 125.

In further configurations, upper 120 may include additional elements. For example, upper 120 can include a toe guard in forefoot region 101 that is formed of a wear-resistant material. Upper 120 can additionally include logos, trademarks, symbols, and placards with care instructions and material information. Those having ordinary skill in the art will appreciate that upper 120 can include still further elements without departing from the scope of the present disclosure.

Many conventional footwear uppers are formed from multiple material elements (e.g., polymer foam, polymer sheets, leather, synthetic leather) that are joined together through stitching or bonding, for example. However, in various embodiments discussed herein, upper 120 can be at least partially formed from a knitted component 130. Knitted component 130 can at least partially extend through forefoot region 101, midfoot region 102, and/or heel region 103. Knitted component 130 can also extend along lateral side 104, medial side 105, over forefoot region 101, and/or around heel region 103. In addition, knitted component 130 can at least partially define an exterior surface 119 and an opposite interior surface 115 of upper 120. Interior surface 115 can define at least a portion of void 117 within upper 120, and exterior surface 119 can face in an opposite direction from the interior surface 115.

As will be discussed, knitted component 130 can provide the upper 120 with weight savings as compared with other conventional uppers. Additionally, in some embodiments, knitted component 130 can be configured with different zones having different characteristics. For example, one or more predetermined zones can have more stretch resistance than other zones. Also, knitted component 130 can provide the upper 120 with aesthetically pleasing features and textures. Still further, knitted component 130 can provide advantages in the manufacture of footwear 100. Other advantages due to the knitted component 130 will be explored in detail below.

Knitted Component Configurations

In some embodiments, knitted component 130 can include a plurality of knitted subcomponents that are independently formed to each have unitary knit construction. Once formed, these knitted components of unitary knit construction can be joined together to define at least a portion of upper 120.

Figure 4:
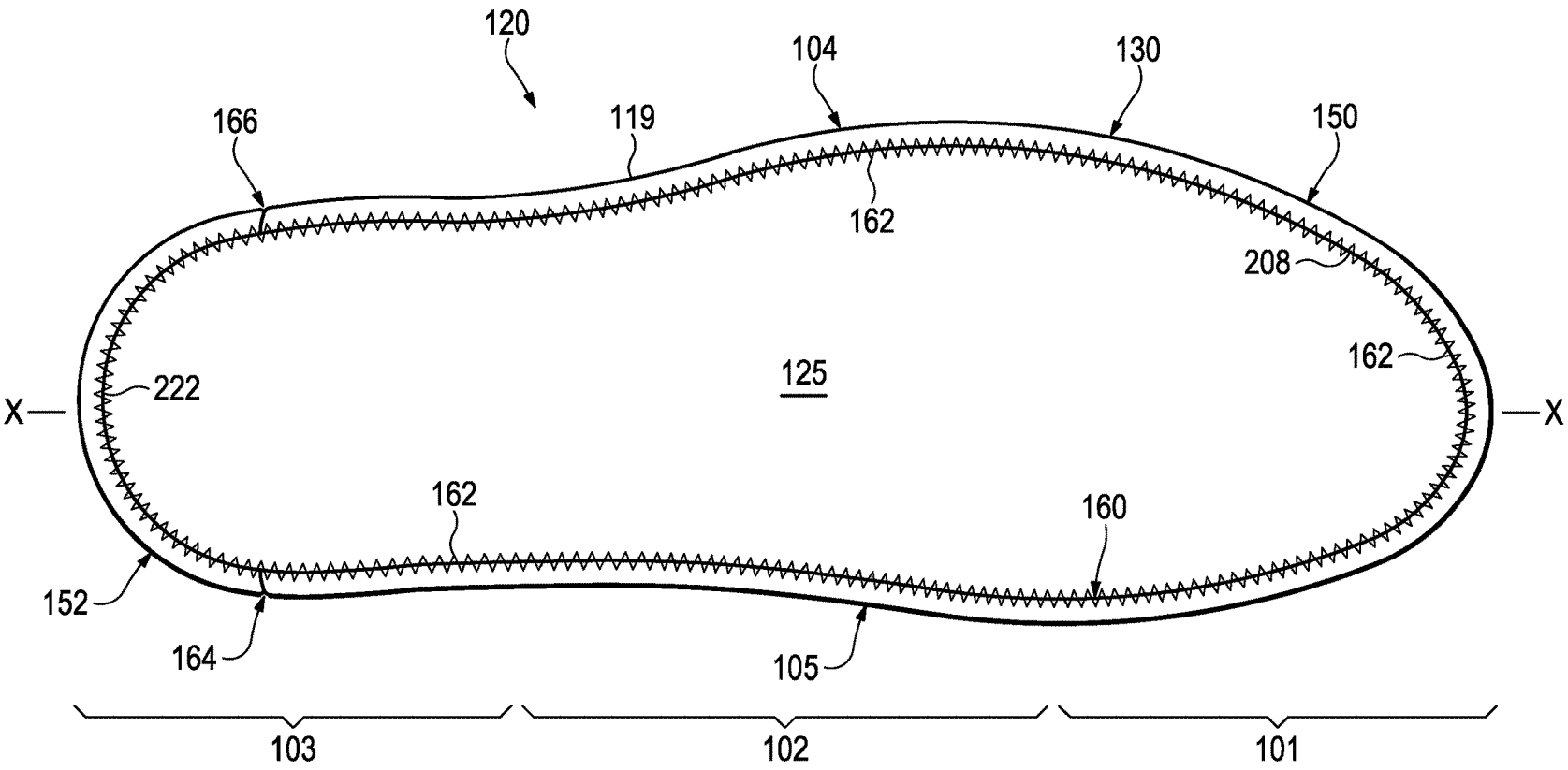
FIG. 4 is a bottom view of an upper of the article of footwear of FIG. 1.
Figure 5:
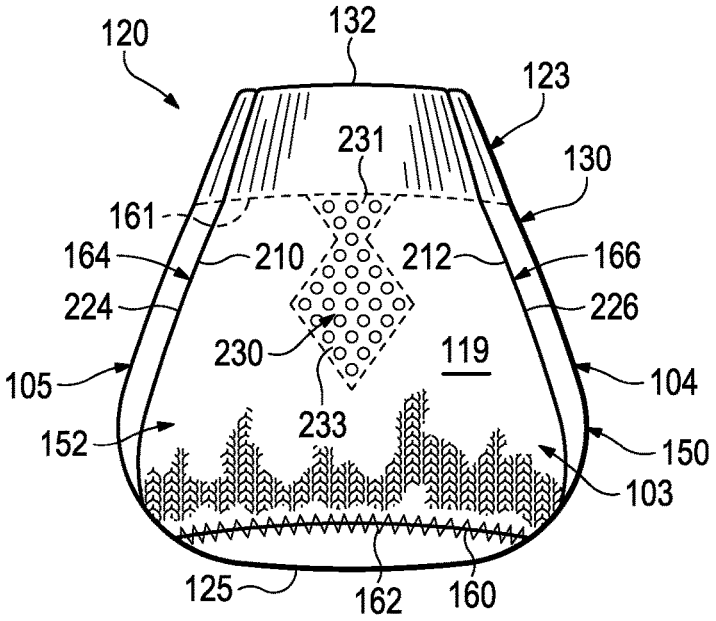
FIG. 5 is a rear view of the upper of the article of footwear of FIG. 1.

For example, as shown in the illustrated embodiments, knitted component 130 can include a first knitted component or forward knitted component 150 and a second knitted component or heel knitted component 152 that are joined together to cooperatively define knitted component 130. In one embodiment, forward knitted component 150, heel knitted component 152, and strobel 125 can be joined together to cooperatively define upper 120 as shown in FIG. 4.

Figure 6:
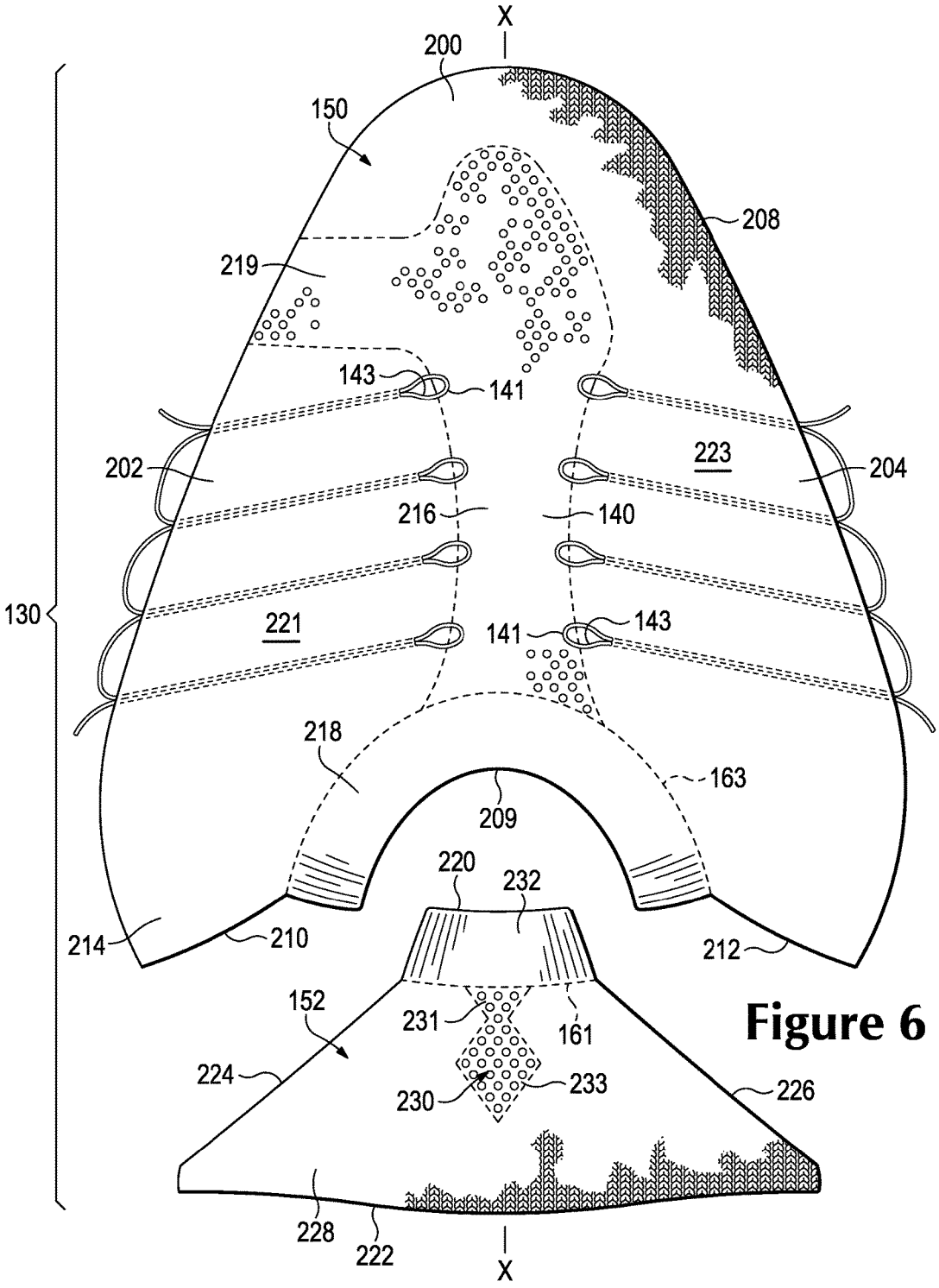
FIG. 6 is a plan view of knitted components of the upper of the article of footwear of FIG. 1.

For purposes of clarity, forward knitted component 150 and heel knitted component 152 are shown separated and laid substantially flat in FIG. 6 according to exemplary embodiments. As shown, forward knitted component 150 is formed of unitary knit construction, and heel knitted component 152 is also formed of unitary knit construction.

As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

As shown in FIG. 6, forward knitted component 150 can include a medial portion 202, a lateral portion 204, and a forward portion 200. Boundaries of forward knitted component 150 can be defined by a first U-shaped peripheral edge 208, a smaller second U-shaped peripheral edge 209, a first rear edge 210 that extends transversely between edge 208 and edge 209, and a second rear edge 212 that extends transversely between edge 208 and edge 209.

Additionally, heel knitted component 152 can include an upper peripheral edge 220, a lower peripheral edge 222, a first side edge 224 that extends transversely between upper peripheral edge 220 and lower peripheral edge 222, and a second side edge 226 that extends transversely between upper peripheral edge 220 and lower peripheral edge 222. In some embodiments, edges 224, 226 may be at least partially angled away from each other as edges 224, 226 extend from upper peripheral edge 220 to lower peripheral edge 222.

Forward knitted component 150 can be coupled to heel knitted component 152 to define upper 120 as shown in FIGS. 1-4. For example, first rear edge 210 of forward knitted component 150 can be coupled to first side edge 224 of heel knitted component 152 to define a first seam 240 of upper 120. Also, second rear edge 212 of forward knitted component 150 can be coupled to second side edge 226 of heel knitted component 152 to define a second seam 242 of upper 120.

Forward knitted component 150 can be coupled to heel knitted component 152 along seam 240 and seam 242 in any suitable fashion. For example, knitted components 150, 152 can be coupled at seam 240 and seam 242 via stitching, via adhesives, via fasteners, or via any other suitable attachment mechanism.

When assembled into upper 120, medial portion 202 of forward knitted component 150 can define a majority of medial side 105 of upper 120. Also, forward portion 200 can define a majority of forefoot region 101 of upper 120. Additionally, lateral portion 204 can define a majority of lateral side 104 of upper 120. Heel knitted component 152 can define a majority of heel region 103 of upper 120. Also, second peripheral edge 209 and upper peripheral edge 220 can cooperate to define upper edge 132 of upper 120 as shown in FIGS. 1-3. Furthermore, first peripheral edge 208 and lower peripheral edge 222 can cooperate to define lower edge 160 of upper 120 as shown in FIG. 4. Moreover, first seam 240 can extend from upper edge 132 to lower edge 160 on medial side 105 of upper 120 as shown in FIGS. 2, 3, and 4. Additionally, second seam 242 can extend from upper edge 132 to lower edge 160 on lateral side 104 of upper 120 as shown in FIGS. 1, 3, and 4.

In some embodiments, forward knitted component 150 may include a plurality of zones that have one or more different physical properties. Boundaries of these zones are indicated by broken lines in the illustrated embodiments. For example, as most clearly illustrated in FIGS. 3 and 6, forward knitted component 150 can include a first zone 214, a second zone 216, and a third zone 218. As shown in the illustrated embodiments, third zone 218 can be U-shaped and substantially centered between medial portion 202 and lateral portion 204, adjacent second peripheral edge 209. Accordingly, an internal boundary 163 of third zone 218 can be located approximately a uniform distance spaced apart from second peripheral edge 209 so as to be substantially concentric with second peripheral edge 209 as shown in the plan view of FIG. 6. Also, second zone 216 can extend forward longitudinally from third zone 218 toward forward portion 200, and second zone 216 can include a medial branch 219 that extends between forward portion 200 and medial portion 202. A first portion 221 of first zone 214 extends between third zone 218, first rear edge 210, peripheral edge 208, and second zone 216. A second portion 223 of first zone 214 extends between third zone 218, second rear edge 212, peripheral edge 208, and second zone 216.

First zone 214, second zone 216, and third zone 218 can have one or more different physical properties. For example, first zone 214 can have a larger degree or a larger amount of stretch resistance than second zone 216, and second zone 216 can have a larger degree or larger amount of stretch resistance than third zone 218. Stated differently, first zone 214 can be stiffer than second zone 216, and second zone 216 can be stiffer than third zone 218. Thus, third zone 218 can stretch readily to allow passage of the wearer's foot through collar 123 of upper 120, whereas first zone 214 can be more stretch resistant such that first zone 214 provides support for the wearer's foot. Moreover, second zone 216 can be stretchable enough to allow upper 120 to comfortably conform to the wearer's foot.

Likewise, in some embodiments, heel knitted component 152 can include a plurality of zones that have one or more different physical properties. Boundaries of these zones are indicated by broken lines in the illustrated embodiments. For example, as most clearly illustrated in FIG. 6, heel knitted component 152 can include a first zone 228, a second zone 230, and a third zone 232.

In an exemplary embodiment, one or more of the different zones 228, 230, 232 may be associated with different portions of heel knitted component 152. By providing different portions of heel knitted component 152 with zones of varying physical properties, the fit, comfort, and/or support provided by heel knitted component to upper 120 may be varied as desired.

In one embodiment, third zone 232 may be provided along a peripheral edge of knitted component 152 that is associated with collar 132 and adjacent to opening 121 of upper 120. An internal boundary 161 of third zone 232 is shown in FIG. 6 in broken lines and partially demarcates third zone 232 from first zone 228 and partially demarcates third zone 232 from second zone 230. As shown in FIG. 6, third zone 232 can have a substantially constant width and can extend along upper peripheral edge 220. Thus, internal boundary 161 of third zone 232 can be located approximately a uniform distance spaced apart from upper peripheral edge 220 so as to be substantially concentric with upper peripheral edge 220 as shown in the plan view of FIG. 6.

In an exemplary embodiment, second zone 230 may be provided in a location along a portion of knitted component 152 that corresponds to a heel and/or Achilles tendon of a foot of a wearer. In this embodiment, second zone 230 may be located approximately in the middle of knitted component 152 along the transverse direction. By providing second zone 230 with a configuration that imparts various physical properties, the portion of knitted component 152 that corresponds to the heel and/or Achilles tendon of a foot of a wearer may have a desired fit, comfort, and/or support.

In different embodiments, second zone 230 may have any suitable shape. In one embodiment, second zone 230 may have a substantially symmetric geometric shape. For example, in this embodiment, second zone 230 can be polygonal. As shown in FIG. 6, second zone 230 can include an inverted triangular portion 231 and a diamond portion 233 that are arranged end-to-end and that extend from third zone 232 toward lower peripheral edge 222. Second zone 230 can also be substantially symmetrical and centered with respect to axis X of upper 120. Moreover, first zone 228 can extend between third zone 232, first side edge 224, lower peripheral edge 222, second side edge 226, and second zone 230.

First zone 228, second zone 230, and third zone 232 can have one or more different physical properties. For example, first zone 228 can have a larger degree or larger amount of stretch resistance than second zone 230, and second zone 230 can have a larger degree or larger amount of stretch resistance than third zone 232. Stated differently, first zone 228 can be stiffer than second zone 230, and second zone 230 can be stiffer than third zone 232.

In some embodiments, first zone 228 of heel knitted component 152 can have similar physical properties as first zone 214 of forward knitted component 150. Also, second zone 230 of heel knitted component 152 can have similar physical properties as second zone 216 of forward knitted component 150. Moreover, third zone 232 of heel knitted component 152 can have similar physical properties as third zone 218 of forward knitted component 150. Thus, for example, first zones 228, 214 can have substantially the same stretch resistance or stiffness, second zones 230, 216 can have substantially the same stretch resistance or stiffness, and third zones 232, 218 can have substantially the same stretch resistance or stiffness.

The varying stretch resistance of each zone 214, 216, 218, 228, 230, 232 can be achieved in various ways. For example, in some cases, each zone 214, 216, 218, 228, 230, 232 can have a different stitching pattern. Additionally, each zone 214, 216, 218, 228, 230, 232 may include different types of yarns or strands. More specifically, in one embodiment, third zones 218, 232 can be formed using a half-gauge knit to provide a ribbed appearance, and third zones 218, 232 can be formed at least partially using one or more elastic yarns, such as spandex. Second zones 216, 230 can be formed using a full-gauge knit and can be formed using one or more elastic yarns, such as spandex. In additional embodiments, second zones 216, 230 can have a mesh-type of appearance for increased breathability. Furthermore, first zones 214, 228 can be formed using a full-gauge knit and can include yarns made from thermoplastic polymeric material. These yarns can be less elastic than yarns included in second and third zones 216, 230, 218, 232, and these yarns can partially melt and fuse to impart additional stiffness to the respective zones 214, 228 after heat is applied to upper 120. It will be appreciated that these thermoplastic yarns can be absent from second and third zones 216, 230, 218, 232. It will also be appreciated that the yarns of each zone 214, 216, 218, 228, 230, 232 can be incorporated and controlled through known intarsia knitting processes. Moreover, the zones 214, 216, 218, 228, 230, 232 can be formed and incorporated according to the teachings in commonly-owned U.S. patent application Ser. No. 13/691,316 to Podhajny, et al., entitled "Article of Footwear Incorporating a Knitted Component," filed Nov. 30, 2012, which is hereby incorporated by reference in its entirety.

It will be appreciated that the knitted component 130 of upper 120 can provide weight savings for the article of footwear 100. Also, the knitted component 130 can provide different physical characteristics at different zones 214, 216, 218, 228, 230, 232 such that upper 120 can be comfortable, can provide localized support to the wearer's foot, and can be easy to put on and remove. Moreover, the knitting processes used to produce knitted component 130 can reduce waste, can reduce manufacturing time, and/or can provide other manufacturing advantages.

Also, as discussed above, knitted component 130 can be formed from a plurality of subcomponents, namely, forward knitted component 150 and heel knitted component 152. As such, properties of knitted component 130 can be highly controlled during manufacture. For example, it will be appreciated that the heel region 103 of upper 120 can be important for providing support to the wearer's heel without sliding or rubbing uncomfortably on the wearer's skin. Thus, heel knitted component 152 can include relatively stiff first zone 228 for providing suitable support. Heel knitted component 152 can also include the more elastic second zone 230, which can be substantially centered on heel knitted component 152, such that the second zone 230 can stretch and conform comfortably against the wearer's heel. The second zone 230 can also stretch and conform as the wearer's heel flexes during walking, running, and otherwise moves. Thus, the heel knitted component 152 can provide an important balance of stiff support and flexure such that a separate heel counter may not be necessary in the article of footwear 100.

Moreover, because the forward knitted component 150 and heel knitted component 152 are separate and independent and are each of unitary knit construction, portions of upper 120 can be tailored and tuned for particular uses, for particular wearers, or for other purposes. For example, if the heel region 103 of upper 120 is to have a different desired physical property, for example to be made stiffer, then forward knitted component 150 could be joined to a different heel knitted component provided with a smaller second zone than second zone 230. Alternatively, if heel region 103 is to be made more flexible, then forward knitted component 150 could be joined to another different heel knitted component provided with a larger second zone than second zone 230.

Manufacturing of knitted components 150, 152 and upper 120 will now be discussed. As mentioned, knitted components 150, 152 can be formed to have one-piece unitary knit construction. For example, knitted components 150, 152 can be knit on flat knitting machines. Also, in some embodiments, heel knitted component 152 can be knit such that upper peripheral edge 220 is formed first, and additional courses can be added until lower peripheral edge 222 is formed. As such, upper peripheral edge 220 can have a neat and finished appearance, and raw lower peripheral edge 222 can be eventually covered and bound by sole structure 110. Likewise, forward knitted component 150 can be formed such that second peripheral edge 209 is formed first, and courses can be added until first peripheral edge 208 is formed.

Figure 7:
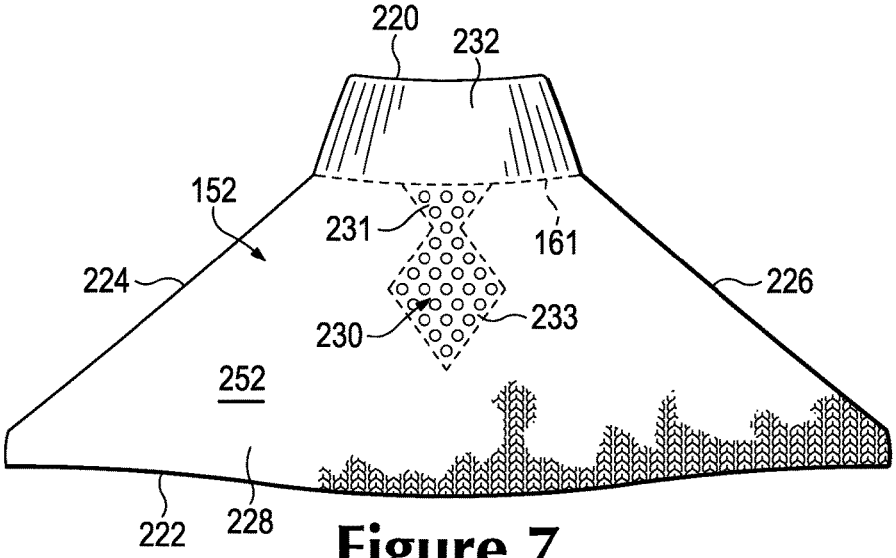
FIG. 7 is a plan view of an exterior surface of a heel knitted component of the upper of the article of footwear of FIG. 1.

Then, knitted components 150, 152 can be joined at seams 240, 242 as discussed above. To facilitate this assembly process, heel knitted component 152 can include an indicia 254, such as an "X" shown in FIG. 8, which differentiates between an interior surface 250 of heel knitted component 152 and an exterior surface 252 of heel knitted component 152. It is noted that exterior surface 252 of heel knitted component 152, shown in FIG. 7, does not include indicia 254. Thus, even if heel knitted component 152 is substantially symmetric, the manufacturer can differentiate between interior and exterior surfaces 250, 252 to assist with orienting heel knitted component 152 for attachment to forward knitted component 150.

Figure 8:
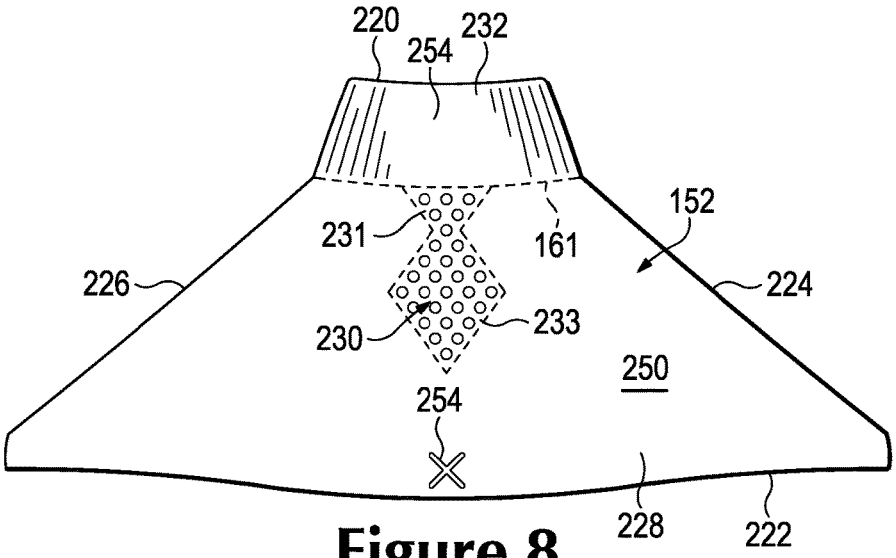
FIG. 8 is a plan view of an interior surface of a heel knitted component of the upper of the article of footwear of FIG. 1.

It is also noted that interior surface 250 can partially define void 117 of upper 120, and exterior surface 252 can face outwardly. Thus, indicia 254 as shown in FIG. 8 can be less visible to the wearer or others when upper 120 is fully assembled. However, it will be appreciated that exterior surface 252 can include indicia 254 instead of interior surface 250. Also, indicia 254 can be formed by yarns or strands included in the unitary knit construction of heel knitted component 152, or indicia 254 can be marked separately from unitary knit construction of heel knitted component 152. Moreover, indicia 254 can be located in any suitable location of heel knitted component 152. For example, as shown in FIG. 8, indicia 254 can be substantially centered on heel knitted component 15 and may be adjacent to lower peripheral edge 222.

Once knitted components 150, 152 are joined at seams 240, 242, strobel 125 can be attached to lower edge 160 as shown in FIG. 4. Then, sole assembly 110 can be attached as discussed above.

Figure 9:
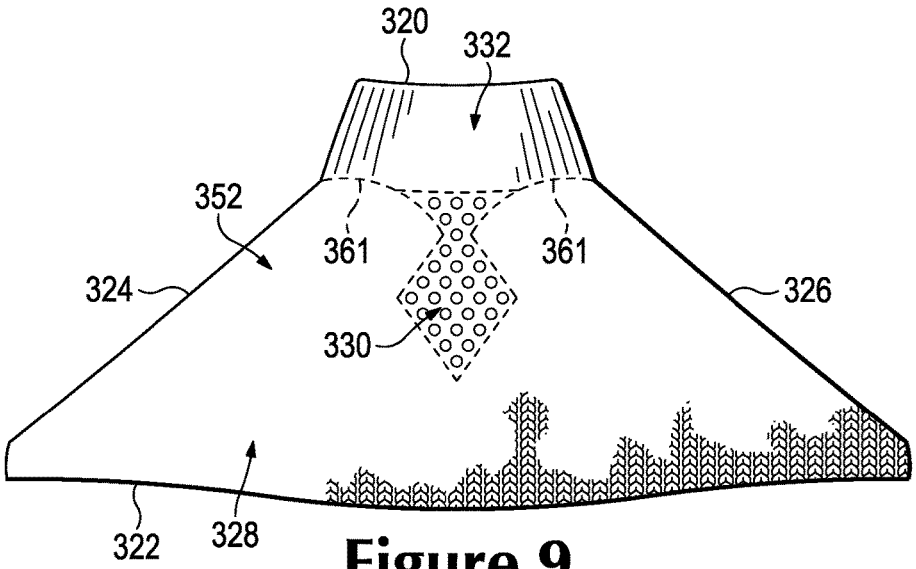
FIG. 9 is a plan view of a heel knitted component according to additional embodiments of the present disclosure.

Referring now to FIG. 9, an alternate embodiment of a heel knitted component 352 is illustrated according to additional teachings of the present disclosure. Heel knitted component 352 can be substantially similar to the embodiments discussed above. For example, heel knitted component 352 can include a first zone 328, a second zone 330, and a third zone 332 similar to the embodiments discussed above. However, heel knitted component 352 can define an internal boundary 361 demarcating third zone 332 from first zone 328 and second zone 330 that differs from the embodiments of FIG. 7. More specifically, while internal boundary 161 is located approximately a uniform distance from upper peripheral edge 220 in the embodiments of FIGS. 6-8, curvature of boundary 361 can be inverted relative to upper peripheral edge 320 such that portions of internal boundary 361 may be spaced apart from upper peripheral edge 320 by varying distances. For example, portions of internal boundary 361 disposed closer to second zone 330 may be spaced apart from upper peripheral edge 320 by a larger distance than other portions. Thus, the width of third zone 332 between upper peripheral edge 320 and internal boundary 361 can vary across third zone 332 in the plan view of FIG. 9. This can allow heel knitted component 352 to conform closely to the wearer's heel for added comfort and support.

In summary, footwear 100 can provide several advantages. Footwear 100 can be comfortable to wear. Footwear 100 can provide support to the wearer's foot. Footwear 100 can also flex with the wearer's foot and can flexibly conform to the wearer's foot. Physical properties can vary across different regions of footwear 100 to further enhance performance.

While various embodiments of the present disclosure have been described, the description is intended to be exemplary rather than limiting, and it will be apparent to those of ordinary skill in the art that many more embodiments and implementations are possible that are within the scope of the present disclosure. Accordingly, the present disclosure is not to be restricted except in light of the attached claims and their equivalents. Also, various modifications, combinations, and changes of the features described herein may be made within the scope of the attached claims.

What is claimed is:

1. An article of footwear comprising:

a sole structure; and an upper having a longitudinal axis, wherein the upper is coupled to the sole structure, the upper including a lower edge that is disposed adjacent to the sole structure, the upper further including:

a collar having an upper peripheral edge defining an opening to a void within the upper;

a forward portion and a heel portion;

wherein the collar circumferentially surrounds the entire opening to the void when the forward portion and heel portion are assembled into the upper, the collar defined by the upper peripheral edge and a lower boundary uniformly spaced from the upper peripheral edge;

the heel portion comprising a knitted component of unitary knit construction, wherein the knitted component of the heel portion has a single uninterrupted first zone and a single uninterrupted second zone, wherein the first zone has a first amount of stretch resistance and the second zone has a second amount of stretch resistance, and wherein the first amount of stretch resistance of the first zone is larger than the second amount of stretch resistance of the second zone, wherein the second zone is located rearwardly of the opening to the void of the upper and substantially centered on the longitudinal axis and substantially centered within the first zone;

wherein the second zone abuts the collar on one side and wherein all other sides of the second zone are surrounded by the first zone;

wherein the collar comprises a third amount of stretch resistance and wherein the third amount of stretch resistance of the collar is less than the second amount of stretch resistance of the second zone; and wherein the knitted component includes a first side edge that is attached to the forward portion along a first side and a second side edge that is attached to the forward portion along a second side.

2. The article of footwear of claim 1 wherein the second zone extends from the collar toward the sole structure, and wherein the first zone extends between the collar, the second zone, the first side edge, the second side edge, and the sole structure.

3. The article of footwear of claim 2, wherein a third zone at least partially defines the collar of the upper and wherein the third zone has a width measured between the upper edge and an internal boundary, the internal boundary partially demarcating the third zone from the second zone and partially demarcating the third zone from the first zone.

4. The article of footwear of claim 1, wherein a yarn in the first zone includes a thermoplastic polymeric material.

5. The article of footwear of claim 4, wherein the thermoplastic polymeric material is substantially absent from the second zone.

6. The article of footwear of claim 1, wherein the forward portion includes a knitted component of unitary knit construction.

7. The article of footwear of claim 6, wherein the first side edge of the heel portion is attached to the forward portion along a medial side of the upper and the second side edge of the heel portion is attached to the forward portion along a lateral side of the upper.

8. The article of footwear of claim 1, wherein the heel portion has an internal surface that partially defines the void, the heel portion also having an external surface that faces opposite the internal surface, and wherein one of the internal surface and the external surface includes an indicia that visually differentiates between the internal surface and the external surface.

9. The article of footwear of claim 1, wherein the upper further includes a strobel that is coupled to the lower edge.

10. The article of footwear of claim 1, wherein the first side edge extends from the upper edge to the lower edge, and wherein the second side edge extends from the upper edge to the lower edge.

11. An article of footwear comprising:

a sole structure; and an upper coupled to the sole structure, the upper comprising:

a forward portion formed of a first component and a heel portion formed of a second component, the first component being separate from the second component;

the forward portion and the heel portion being joined to each other along at least one seam;

a collar portion circumferentially surrounding an opening to a void formed by the upper when the forward portion and heel portion are joined, the collar having an upper peripheral edge and a lower boundary that is uniformly spaced from and concentric with the upper peripheral edge;

the heel portion comprising a heel knitted component of unitary knit construction, the heel knitted component having a first uninterrupted knitted zone associated with a first amount of stretch resistance and a second uninterrupted knitted zone associated with a second amount of stretch resistance; wherein the second knitted zone is located rearwardly of the opening to the void of the upper, and wherein the first amount of stretch resistance of the first knitted zone is larger than the second amount of stretch resistance of the second knitted zone; and wherein the second zone abuts the collar on one side and wherein all other sides of the second zone are surrounded by the first zone.

12. The article of footwear of claim 11, wherein the upper defines a longitudinal axis, and wherein the second knitted zone is substantially centered on the heel knitted component with respect to the longitudinal axis.

13. The article of footwear of claim 11, wherein the heel knitted component includes the first knitted zone, the second knitted zone, and a third knitted zone, wherein the third knitted zone is associated with a third amount of stretch resistance, wherein the first amount of stretch resistance of the first knitted zone is larger than the second amount of stretch resistance of the second knitted zone, and wherein the second amount of stretch resistance of the second knitted zone is larger than the third amount of stretch resistance of the third knitted zone.

14. The article of footwear of claim 13, wherein the at least one seam includes a first seam and a second seam, wherein the third knitted zone partially defines the collar of the upper, the collar defining an opening to a void within the upper, wherein the second knitted zone extends from the third zone toward the sole structure, and wherein the first knitted zone extends between the third knitted zone, the second knitted zone, the first seam, the second seam, and the sole structure.

15. The article of footwear of claim 11, wherein the at least one seam includes a first seam and a second seam, wherein the forward portion of the upper includes a forward knitted component of unitary knit construction, the forward knitted component and the heel knitted component being joined at the first seam and the second seam via respective stitching.

16. The article of footwear of claim 11, wherein a yarn in the first knitted zone includes a thermoplastic polymeric material, the thermoplastic polymeric material being substantially absent from the second knitted zone.

17. The article of footwear of claim 11, wherein the heel portion and the forward portion cooperate to define a lower edge that is disposed adjacent the sole structure, the heel portion and the forward portion cooperating to define the collar that defines an opening to a void within the upper, the collar having an upper edge that is spaced away from the lower edge, wherein the at least one seam includes a first seam and a second seam, each of the first seam and the second seam extending from the upper edge to the lower edge.

18. An article of footwear comprising:

a sole structure; and an upper coupled to the sole structure, the upper including a lower edge that is disposed adjacent the sole structure, the upper including a collar defining an opening to a void within the upper, the collar defining an upper edge of the upper that is spaced away from the lower edge, the upper also comprising:

a forward portion including a forward knitted component of unitary knit construction; and a heel portion including a heel knitted component of unitary knit construction, the heel portion located rearwardly of the opening to the void within the upper, the heel portion having a first knitted zone, a second knitted zone, and a third knitted zone, the first knitted zone associated with a first amount of stretch resistance, the second knitted zone associated with a second amount of stretch resistance, the third knitted zone associated with a third amount of stretch resistance;

wherein the first amount of stretch resistance is larger than the second amount of stretch resistance, and the second amount of stretch resistance is larger than the third amount of stretch resistance;

wherein the third knitted zone partially defines the collar, wherein the second knitted zone is cooperatively surrounded by the first knitted zone and the third knitted zone, and wherein the second zone is substantially centered within the first zone;

wherein the second zone abuts the collar on one side and wherein all other sides of the second zone are surrounded by the first zone; and the heel knitted component including a first edge that is joined via stitching to the forward knitted component, wherein the first edge comprises the first stretch resistance; the forward knitted component including a second edge that is joined via stitching to the first edge of the heel knitted component, wherein the second edge comprises the first stretch resistance.

* * * * *